US005924707A

United States Patent [19]

Metrot

[11] Patent Number: 5,924,707

[45] Date of Patent: Jul. 20, 1999

[54] SNOWBOARD EQUIPPED WITH A SHOCK-ABSORBING DEVICE

[75] Inventor: Eric Metrot, Saint-Jorioz, France

[73] Assignee: Salomon S.A., Metz-Tessy, France

[21] Appl. No.: 08/919,314

[22] Filed: Aug. 28, 1997

[30] Foreign Application Priority Data

Aug. 29, 1996 [FR] France ..... 96 10698

[51] Int. Cl.[6] ..... A63C 9/00

[52] U.S. Cl. ..... 280/14.2; 280/602

[58] Field of Search ..... 280/607, 602, 280/609, 14.2, 11.14, 616, 617, 618, 634

[56] References Cited

U.S. PATENT DOCUMENTS

| | | | |
|---|---|---|---|
| 3,900,204 | 8/1975 | Weber | 280/11.13 S |
| 4,865,345 | 9/1989 | Piegay | 280/602 |
| 5,284,357 | 2/1994 | Tinkler | 280/602 |
| 5,332,252 | 7/1994 | Le Masson et al. | 280/602 |
| 5,441,296 | 8/1995 | Phelipon et al. | 280/602 |
| 5,597,170 | 1/1997 | Le Masson et al. | 280/602 |

FOREIGN PATENT DOCUMENTS

| | | |
|---|---|---|
| 0682961 | 11/1995 | European Pat. Off. . |
| 0692284 | 1/1996 | European Pat. Off. . |
| 2665081 | 1/1992 | France . |
| 2713102 | 6/1995 | France . |
| 2729086 | 7/1996 | France . |
| WO 93/08883 | 5/1993 | WIPO . |
| WO 94/08669 | 4/1994 | WIPO . |

*Primary Examiner*—Richard M. Camby
*Attorney, Agent, or Firm*—Greenblum & Bernstein P.L.C.

[57] ABSTRACT

The invention relates to a shock absorption device comprising at least one elongated element for transmitting flexional forces, oriented longitudinally with respect to the ski and having a free end adapted to be displaced longitudinally during bias in flexion. The device comprises likewise: a housing rigidly connected to the ski, provided with an opening for the passage of the free end of the elongated element and an internal seat allowing for the free back and forth movement of the said free end in translation; at least one shock absorption plate guided in translation in the said seat, comprising at least one layer made out of flexible and/or viscoelastic material in direct contact with the free end; and an indexing means making it possible to select the number of small plates in the translationally latched position in this said seat, and whose layer of flexible and/or viscoelastic material is biased in shear during displacement of the free end in the seat.

19 Claims, 9 Drawing Sheets

FIG. 8
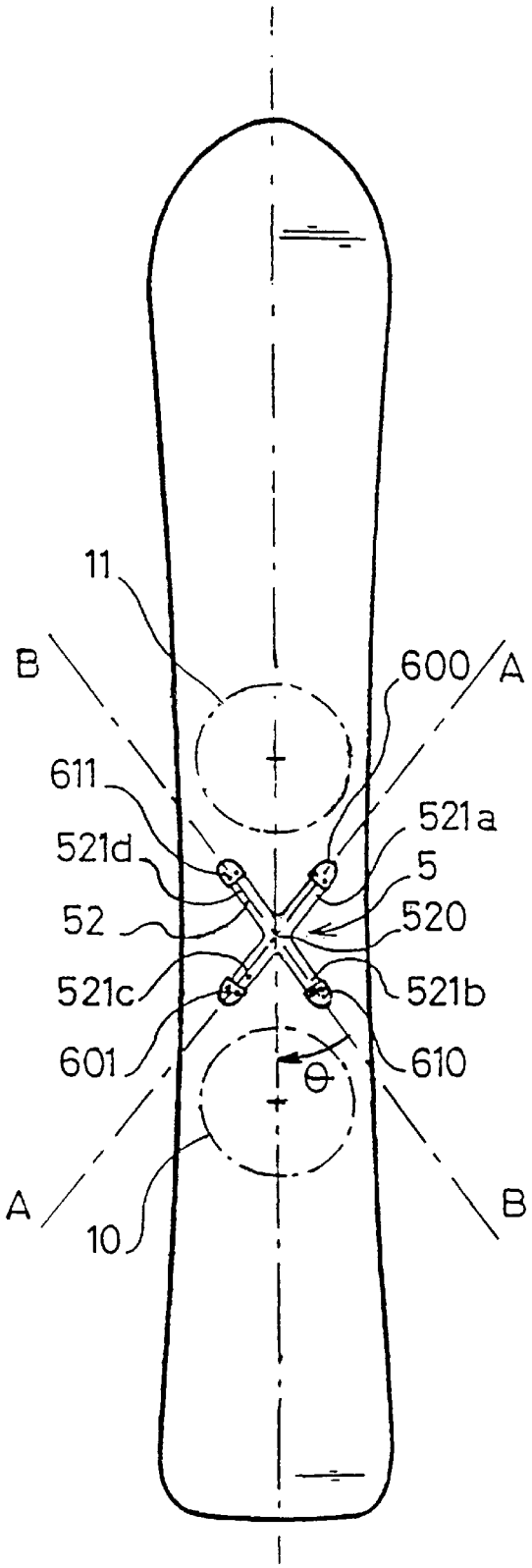
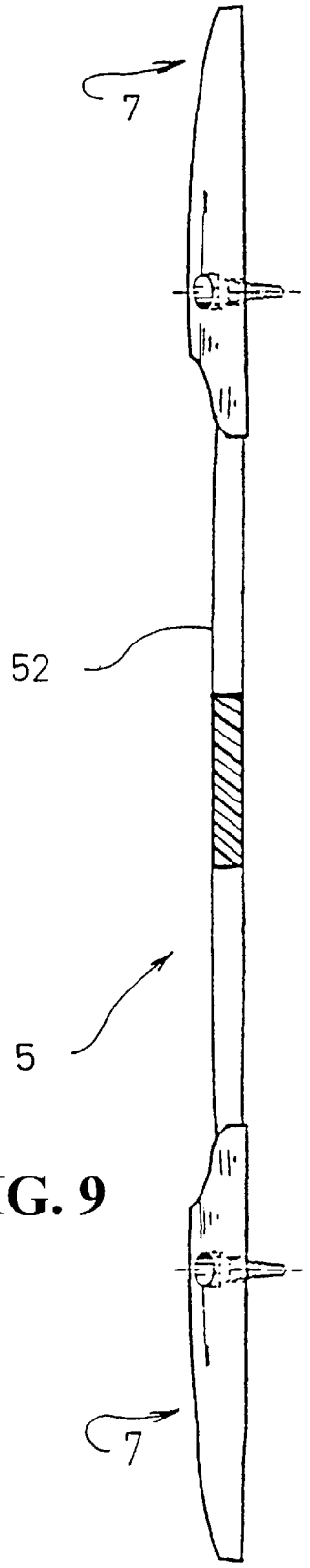
FIG. 9

SNOWBOARD EQUIPPED WITH A SHOCK-ABSORBING DEVICE

BACKGROUND OF THE INVENTION

1. Field of the Invention

The invention is related to an improved snowboard.

2. Description of Background and Relevant Information

A snowboard is device for gliding over snow on which both feet of the user are separated from one another along the board and are fixed along a substantially transverse or inclined orientation with respect to the longitudinal axis of the board.

U.S. Pat. No. 3,900,204 is the first disclosure to teach the most suitable positioning of the bindings for the practice of this sport.

In the practice of this discipline, the rocking forces generated at turns are translated by a combination of substantial bending and torsional forces between the feet of the snow boarder. Consequently, this portion of the board is a zone subject to deliberately forceful stresses which the snowboarder must be able to master under all circumstances.

However, it has been measured, especially at very fast speeds, that this portion of the board is subject to localized vibrational phenomena appearing at frequencies greater than 10 Hertz, and most of these are caused by small jolts and the unevenness of the terrain, and have nothing to do with the deliberate deformations caused by the snowboarder himself when he executes turns. These vibrational phenomena disturb the performance of the board, which thus become difficult to handle.

Thus, there is a need for shock-absorption between the feet of the snowboarder, while simultaneously retaining a certain flexibility in bending and torsion that is necessary to handle the board in a turn. The main objective is therefore to dampen the adverse vibrations without adding static stiffness in the central zone.

The document FR-A-2 665 081 is related to a snowboard having a symmetrical construction with a shock-absorption device located, in all cases, at the front of the board in an asymmetrical manner so as to provide a shock-absorption that is preponderant on the "back-side". In a known manner, this is a plate having a high modulus that stresses a layer of visco-elastic material connected to the board.

However, it has been noted that in the current manner of snowboarding, the front and rear zones are used to make figures by taking support on these zones and taking advantage of their elasticity in order to bound or jump.

One especially famous figure style, known as "Ollie" consists of taking support on the rear of the board with one's entire weight and then of taking advantage of the spring effect to surge forward. As such, it is important not to diminish the elasticity in these zones with a shock-absorption device.

In addition, the device according to this document adds too much stiffness to the zone where it is located due to the fact that the elongate facing is adhered along the entire surface of the board. Thus, one cannot equip the central portion of the snow board with such a device without affecting its flexibility, and therefore the ease of handling of the board.

The document FR 2 729 086 is related to a snowboard equipped with a shock-absorption device formed of visco-elastic strips that are stressed by a material having a high elasticity modulus and as such, this disclosure has the same disadvantages as the solution of the document FR-A-2 665 081.

SUMMARY OF THE INVENTION

Thus, it is an object of the instant invention to provide a satisfactory solution to the above-cited problems related to the shock-absorption of a snowboard.

In order to accomplish this, the invention is related to a snowboard comprising two binding mounting zones, spaced longitudinally along the surface of the board, a central portion located between the mounting zones, end portions located on either side of the mounting ones, and at least one of the end portions ending in a raised edge. In addition, the board comprises a shock-absorption device connected to the board in the central portion, equipped with at least one elongate element for transmitting the bending and/or torsion stresses of the central portion, the element having at least two opposing end portions connected to the board, and between such end portions, a central portion that is free in translation without any connection with the board; at least one of the end portions being in contact with a shock-absorption mechanism that dissipates the energy resulting from the translational, and possibly rotational displacements of the end portion during the bending and/or torsional deformations of the central portion of the board by shearing or friction.

A board equipped with such a device retains its properties of flexibility during bending and torsion at the center, and this promotes ease of handling while taking turns; its ends also retain their responsiveness for the execution of figures and jumps provides a satisfactory response in terms of dampening the vibrations in the zones where a shock-absorption is necessary to handle the board, even at high speeds and over bumpy terrain.

According to an advantageous characteristic of the invention, the shock-absorption device is constituted by two elongate transmission elements that are oriented substantially along the longitudinal direction of the board and that are spaced laterally from one another and located on either side of the longitudinal median axis. This favors the absorption of vibrations during combined bending and torsional deformations, with a preponderance towards bending due to the longitudinal orientation of the transmission elements.

According to a variation, the shock-absorption device is constituted by an elongate element in the shape of a cross comprising a central portion that is without any connection with the board, and starting from the central portion, four end portions form the opposing arms in pairs. In this case, it is preferable that the elongate element be oriented along the board in such a away that each portion extends along a preferred direction, forming an orientation angle of approximately 45 degrees with respect to the longitudinal direction of the board.

In this case, preference is given to the dissipation of energy caused during the maximum torsional deformations mainly due to the vibrations, without creating any stiffness in the central portion of the board.

BRIEF DESCRIPTION OF THE DRAWINGS

Other characteristics and advantages of the invention will become apparent from the description that follows with reference to the annexed drawings which are provided only as non-limiting examples thereof, wherein:

FIG. 8 is a view similar to the view of FIG. 1 according to a variation of the invention;

FIG. 9 is a side, partially sectional view of the device according to FIG. 8;

DETAILED DESCRIPTION OF THE PREFERRED EMBODIMENTS

Figure 1:
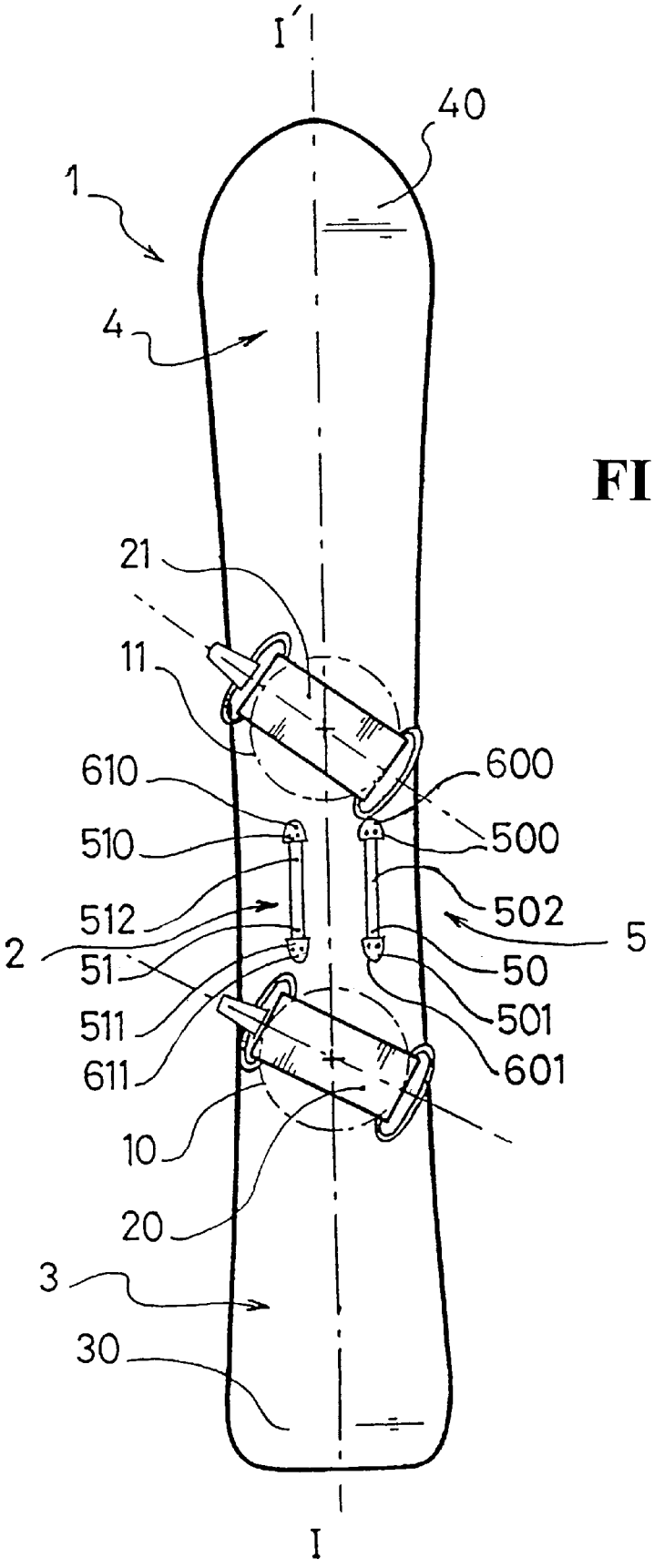
FIG. 1 is a top view of a snowboard equipped with binding elements.
Figure 2:
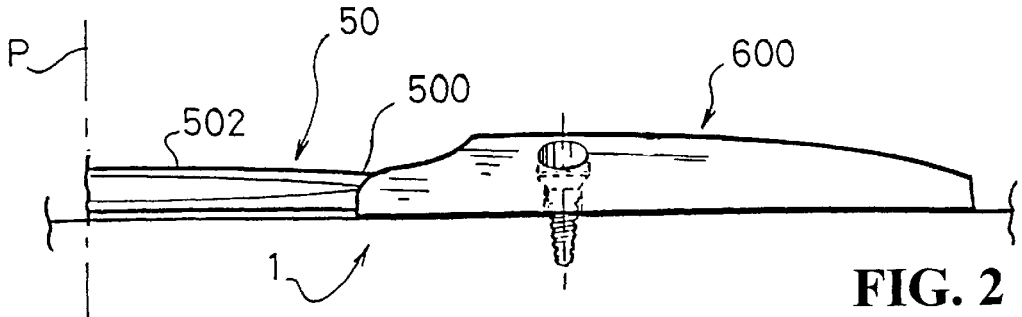
FIG. 2 is a partial side view of a shock-absorption device.
Figure 3:
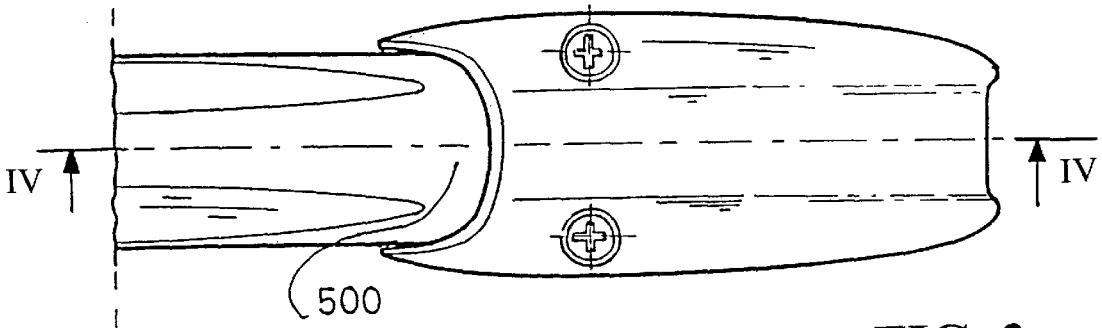
FIG. 3 is a top view of the element of FIG. 2.
Figure 4:
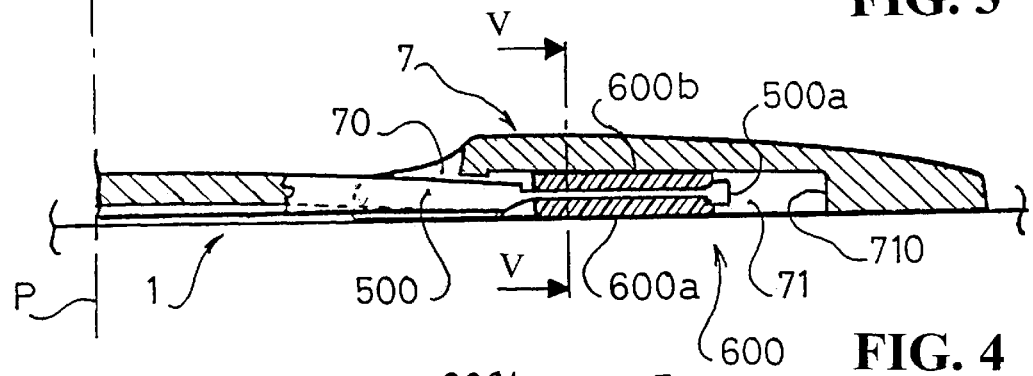
FIG. 4 is a sectional view taken along line IV—IV of FIG. 3.
Figure 5:
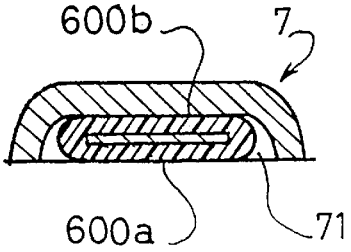
FIG. 5 is a sectional view taken along line V—V of FIG. 4.

With reference to FIG. 1, the drawing illustrates a snowboard 1 for snowboarders who keep their left foot at the back, or in a "goofy" position, and comprises two mounting zones, viz., a rear zone 10 where the rear binding 20 is located, and a front zone 11 where the front binding 21 is located. Between the two zones 10, 11 that have been illustrated schematically in a circular fashion due to the possibility of the angular displacement of the bindings, is located a central portion 2. Towards the rear of the rear zone is the rear end portion 3 that end in a raised edge 30. Similarly, the front end 4 is located beyond the front zone and it ends in a raised edge 40. The board as illustrated represents a non-limiting example, and it would be possible to envision a single raised edge at the front, for example.

According to the invention, the central portion 2 comprises a shock-absorption device 5 that is connected to the board and comprises two separate elongate elements 50, 51 for transmitting the bending and torsional stresses. The two elongate transmission elements 50, 51 are oriented substantially along the longitudinal direction of the board and are spaced laterally from one another and located on either side of the longitudinal median axis I-I'. These elements each have a first end portion 500, 510 and a second end portion 501, 511 that are connected to the board. Between the end portions of each element is located a central portion 502, 512 that has the special characteristic of having no connection with the board, and of thus being free, especially in translation, during the deformation of the central portion of the board during bending and/or torsion. The end portions 500, 510, 501, 511 are all connected to the board via flexible shock-absorption devices 600, 610, 601, 611 that will be described in detail below. The device thus adds much less stiffness compared to a shock-absorption element that is connected along its entire length via a flexible means, as is the case in the prior art cited previously.

The arrangement of the two elements 50, 51 that are laterally spaced from one another and, preferably in the vicinity of each edge of the board, has the advantage of being able to handle both the pure bending deformations, i.e., maximum in the orientation along the axis I-I' as well as the torsional deformations, oriented in an inclined manner with respect to the axis I-I' (maximum at ±45 degrees with respect to I-I').

The details of element 50 equipping the board are illustrated in FIGS. 2 through 5. The other element 51 has an identical design and the following description applies equally to such element 51. Similarly, only one of the halves of element 50 has been represented and described in the following description and it is to be understood that the element has been designed symmetrically with respect to the vertical and transverse plane P passing through the center of such element.

The elongate element 50 thus comprises a central portion 502 which is not connected to the upper surface of the board by any type of connection arrangement such as adhesive, for example. In other words, this portion is free in longitudinal translation, but it also has a certain capacity for vertical displacement with respect to the surface of the board depending on the bending and torsional stresses that are applied onto the central portion of the board.

The elongate element is extended at the end by an end portion 500 that is connected to the board via a flexible connection mechanism 600.

The connection is thus ensured by layers of flexible material, preferably a visco-elastic material 600*a*, 600*b*. This flexible shock-absorption mechanism 600 allows a translational displacement of the end 500*a* of the end portion 500.

A protection and guiding device 7 covers the end of the portion that is free in translation and is fixedly connected to the board.

This protection and guiding device 7 is a casing through which an opening 70 is provided for the passage of the end of the free portion and leads to a housing 71. The housing contains a or quantity of visco-elastic material surrounding the end of the free portion, thus forming an upper layer 600*b* adhered on top of housing 71 and on top of the end, and a lower layer 600*a* adhered on top of the board and beneath the end. Under no circumstances can the end 500*a* come into abutment against the base 710 of the housing of the casing under normal conditions of use.

During the displacement of the end 500*a* in the housing 71, the layers of visco-elastic material 600*a*, 600*b* are stressed together during shearing and dissipate the energy transmitted by the elongate element.

Preferably, the visco-elastic material is an elastomer whose Shore Hardness A is comprised between 5 and 85, whose elasticity modulus is comprised between 1 and 150 MPA and whose shock-absorption coefficient is comprised between 0.1 and 2.5.

Some of these materials are preferred over others, such as mastics, due to their self-adhesive properties that do not necessitate the use of adhesives. Generally, these mastics have shock-absorption coefficients and moduli that vary substantially depending on the temperature. In order to identify those that can be used, we consider that they must have a modulus comprised between 1 and 20 MPA and a shock-absorption coefficient comprised between 0.1 and 2.2 for a useful temperature range comprised between −20 and +20 degrees.

The use of other synthetic rubbers or elastomers is not excluded. However, it will generally be necessary to stick these layers via an appropriate adhesive.

Figure 6:
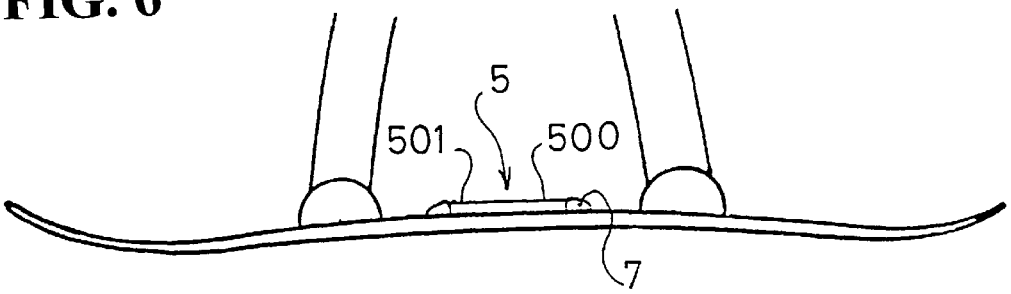
FIG. 6 shows a side view of a board according to the invention, on which a snowboarder is mounted in the resting position.
Figure 6A:
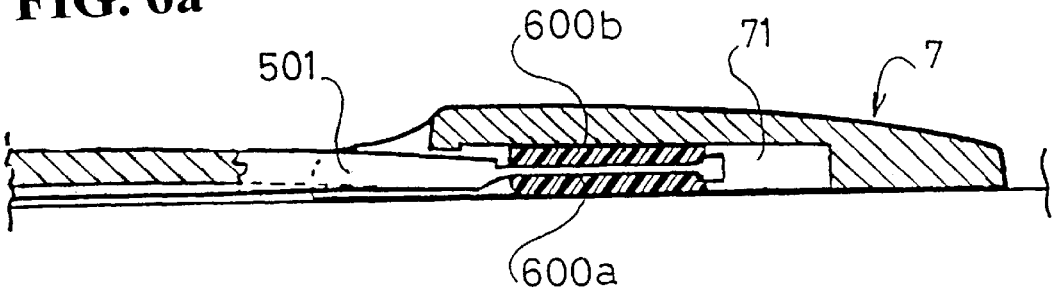
FIG. 6*a* is a detailed sectional view like that of FIG. 4 but in the configuration of FIG. 6.
Figure 7:
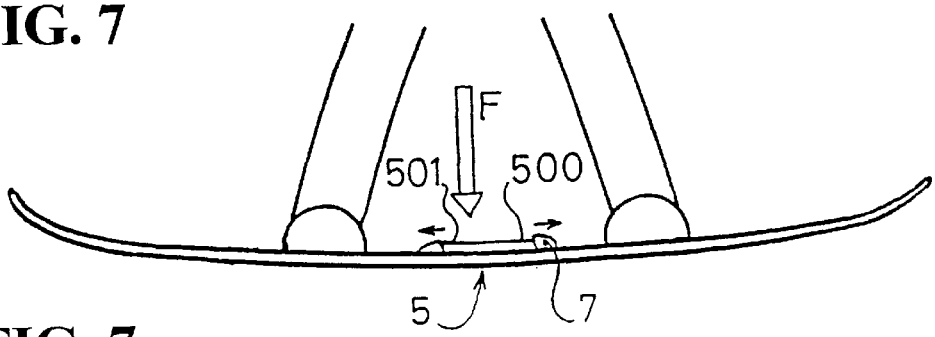
FIG. 7 illustrates a pure bending deformation of the board.
Figure 7A:
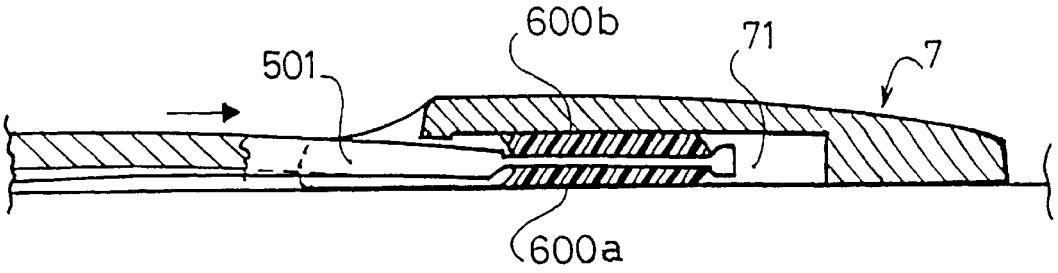
FIG. 7*a* is a sectional view that is similar to FIG. 6*a* in the configuration of the deformation of FIG. 7.

FIGS. 6, 6*a*, 7, 7*a* schematically represent the functioning of the shock-absorption device. FIG. 6 shows the board in a state of rest, and FIG. 7, when it is being bent. During bending, the central portion becomes deformed, for example, along the direction F of FIG. 7; this causes a longitudinal displacement relative to the end portions 500, 501 with respect to the surface of the board; and especially within the casings 7. This displacement leads to the shearing of the layers of visco-elastic material 600*a*, 600*b* and thus shock-absorption due to the energy dissipated in the material. The free bending of the board, especially its central portion, is hardly influenced by the fact that the elongate element is "floatably" mounted and is not rigidly connected to any spot to the board, and that the central portion especially is capable of being displaced with respect to the surface of the board.

FIGS. 8 and 9 illustrate a variation of the invention wherein the shock-absorption device 5 is constituted of an elongate element in the shape of a cross 52 comprising a central portion 520 without any direct connection with the board and starting from the central portion, four end portions 521*a*, 521*b*, 521*c* and 521*d* form arms that are aligned and opposed in pairs. As regards these end portions, they are connected to the board via flexible shock-absorption mechanisms 600, 601, 610, 611.

The elongate element 52 is oriented along the board in such a way that each end portion extends along a preferred direction (A—A; B—B) forming an orientation angle Θ of approximately 45 degrees with respect to the longitudinal direction I-I' of the board. In this configuration, torsional shock-absorption is favored.

Preferably, the central portion 520 is located at a point that is equidistant from the two mounting zones 10, 11.

FIG. 9 shows the shock-absorption element whose construction principle is based on the previous embodiment.

The ends of each end portion is engaged in the protection and guiding devices or casing 7, that number four in all. Inside, the construction is identical to that of FIG. 4.

Figure 10:
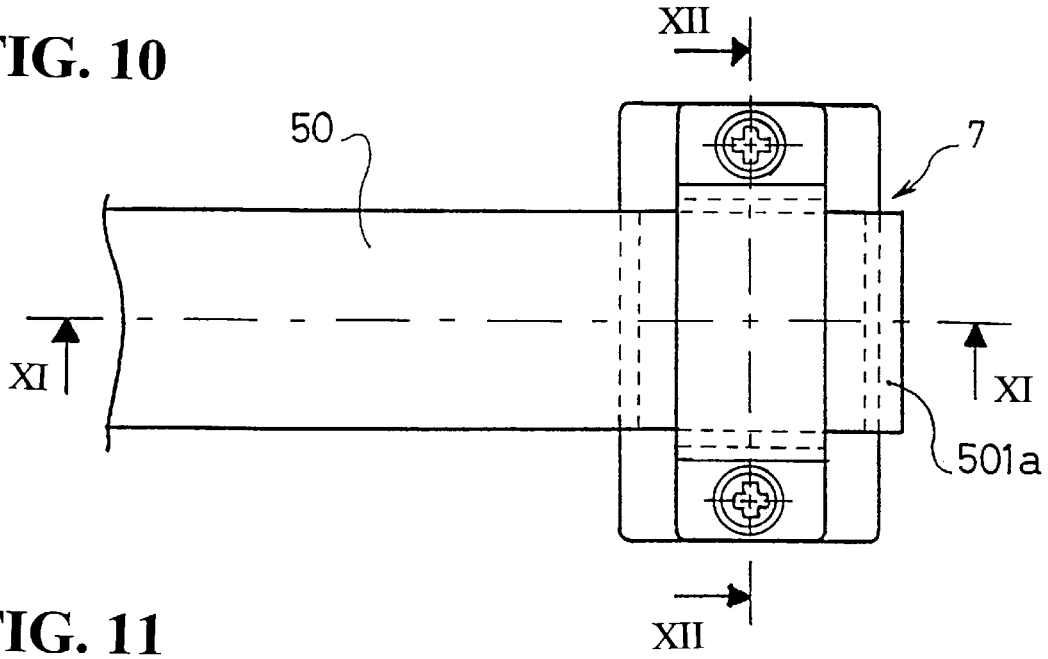
FIG. 10 is a top view of a detail of the device according to another variation.
Figure 11:
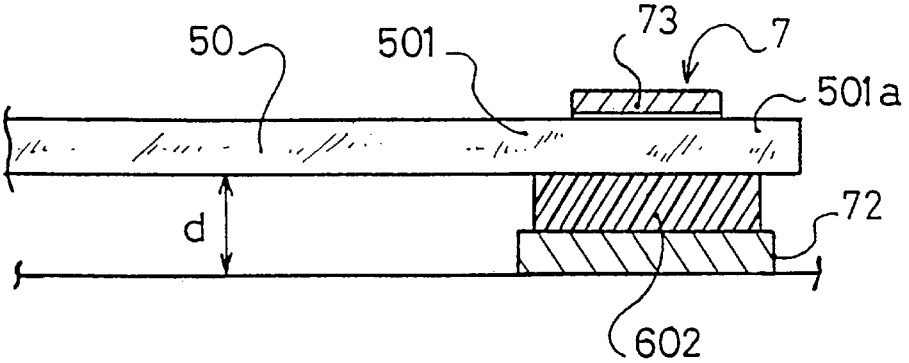
FIG. 11 is a sectional view taken along line XI—XI of FIG. 10.
Figure 12:
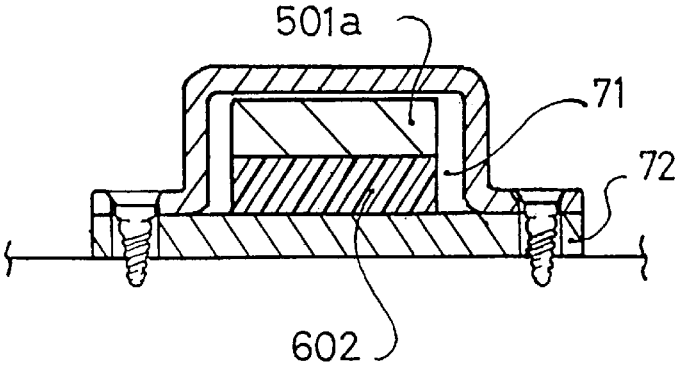
FIG. 12 is a sectional view taken along line III–XII of FIG. 10.
Figure 13:
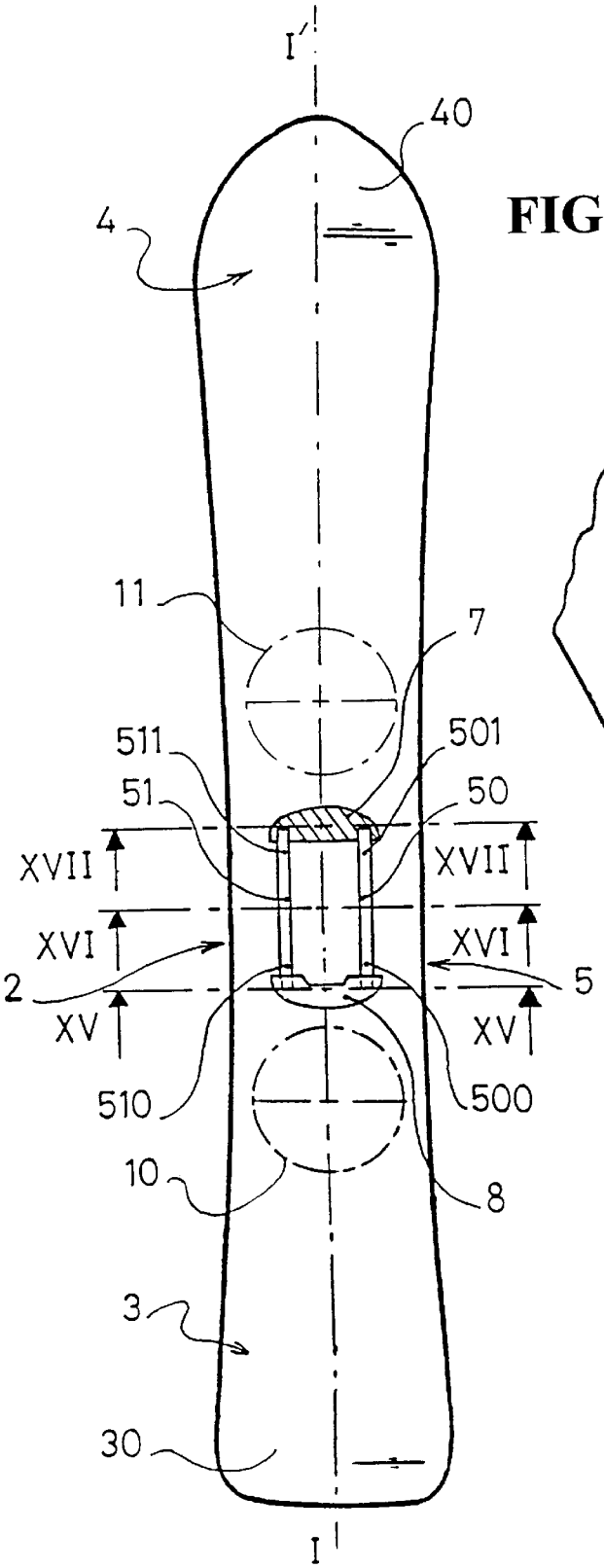
FIG. 13 is a top view of a board according to another variation of the invention.

According to a different embodiment illustrated in FIGS. 10 through 12, the protection and guiding device 7 is a stirrup that includes a shim 72 upon which a guiding element 73 is affixed; a guiding housing 71 through which the end 501*a* of the free portion 501 is adapted to be displaced in translation; a layer of visco-elastic material 602 is provided at the contact between the shim 72 and the end. In this case, provision has been made for just one layer of flexible material for the purpose of simplification. The purpose of the shim is to maintain the elongate element in the form of a facing at a distance d from the surface of the board in order to avoid any friction along the element with the board. The main function of the guiding element 73 is to ensure the translational guidance of the elongate element during the displacement of the free portion 501, and also to avoid the adhesive link between the end of the element and the visco-elastic layer 602, or the link between the layer 602 and the shim 72 from getting ripped off.

In some cases it would be possible to envision eliminating the guiding element 73 whilst still remaining within the scope of the invention.

Regardless of the embodiment, the elongate element for transmitting the bending and/or torsional stresses can be provided in the form of blands, profiles, rings, rods or plastic tubes, whether reinforced or otherwise.

In order to ensure a good transmission of the forces, the element must be constituted of a material having a high modulus, selected from among metals and composite resin, fiber glass, carbon, acrylic, polyester based materials and a mixture of such fibers, as well as from among certain high modulus plastics.

In the context of FIG. 1, the device comprises two separate elements that extend longitudinally along the board. It would also fall within the scope of the invention to provide a shock-absorption device constituted of a single element 50. In this case, the element can be located in a laterally offset manner with respect to the axis I-I', or even be located in an aligned manner along the longitudinal axis I-I'. In the latter case, only the shock-absorption of the longitudinal bending of the board is taken into account.

FIGS. 13 through 17 illustrate another possible variation of the invention. In this case, the shock-absorption device comprises two elongate elements 50,51 constituted of rods that have been spaced laterally with respect to one another and located on either side of the median axis I-I'.

In this embodiment, the end portions 500, 510 of the two rods 50, 51 are fixedly connected to the board via a fixed connection device that maintains a firm grip on the ends and does not allow for the possibility of any translational or rotational movement.

In addition to this connecting arrangement, each rod is extended by an opposite end portion 501, 511 connected to the board via a flexible connecting arrangement 600 that comprises a casing 7 which is rigidly affixed to the board.

Figure 14:
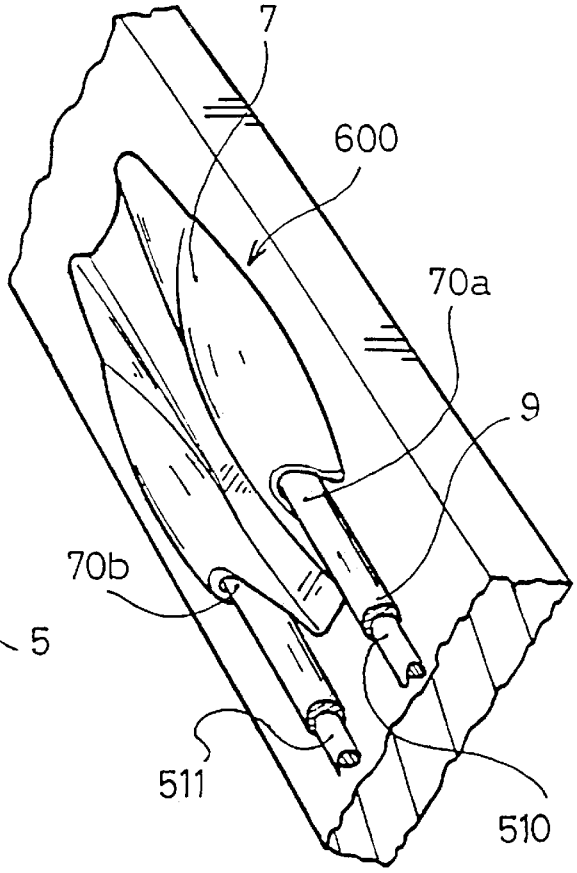
FIG. 14 is an enlarged view of a detail of FIG. 13.
Figure 15:
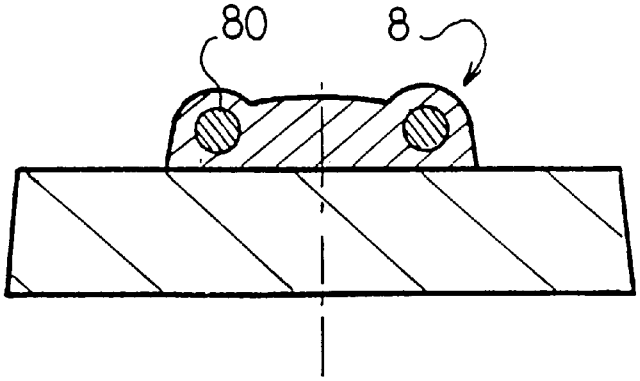
FIG. 15 is a sectional view taken along line XV—XV of FIG. 13.
Figure 16:
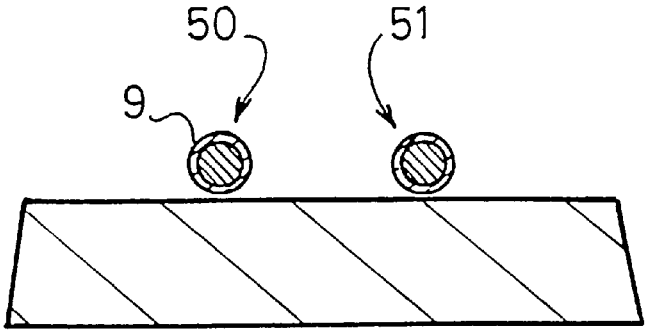
FIG. 16 is a sectional view taken along line XVI—XVI of FIG. 13.
Figure 17:
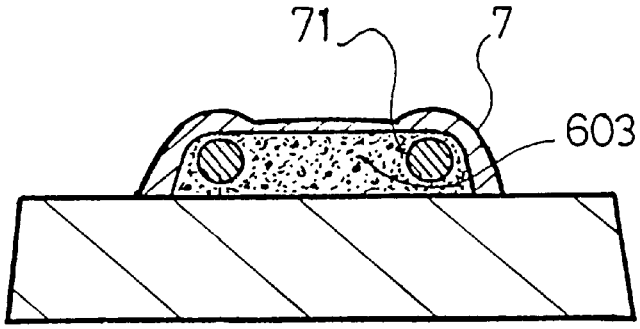
FIG. 17 is a sectional view taken along line XVII—XVII of FIG. 13.

As is shown in FIG. 14, the casing comprises openings 70*a*, 70*b* in order to enable the introduction of the ends of the free portions 510, 511, both in translation and also in rotation.

A recess 71 is provided within casing 71 in order to allow a free displacement of each rod in translation.

The volume is totally or partially filled with a block of visco-elastic material 603. Each end having a substantially cylindrical section, is thus surrounded by the material.

In order to facilitate the assembly of the shock-absorbing device, while at the same time ensuring the constant spacing of the rods, the fixed connection device, located across from it, is presented in the form of a second housing 8 connected to the board by any means such as welding, screwing, adhesive etc.

The fixed portions of the rods are themselves affixed in the casing 7 by means of an adhesive layer 80, for example.

A protective sheath 9 surrounds the rods between the fixed connection arrangement 8 and the shock-absorbing casing 7.

The advantage of this embodiment lies in the fact that it efficiently absorbs both the bending deformations as well as the torsional deformations by virtue of the freedom of movement that is conferred on the end portions 510, 511 both in translation, as well as in rotation. It is not essential that the rods be assembled in parallel, and they can also have different lengths in order to provide asymmetrical shock-absorption, for example.

The rods can also have a non-circular section, such as a flattened, substantially semi-circular or oval shape, for example. They can have a filled or hollow section as well.

The embodiment of FIGS. 13 through 17 represents a simplified and more economical example of the invention, wherein the flexible shock-absorption arrangement is present only at one of the two ends of each rod, whereas the other end is rigidly affixed to the board. It is to be understood that one could envision providing an identical shock-absorption arrangement at each end of each rod, as was the case in the previous embodiments.

In the possible variations of the invention, it could be envisioned that the flexible shock-absorption mechanisms 600, 601, 610, 611 of the embodiments described and illustrated be replaced by a friction shock-absorption arrangement that comprises a friction layer having a friction surface that is covered with a material having a high friction coefficient. In this case, the friction layer can be directly or indirectly connected to the board and it can brake the translational, and possibly the rotational displacements of the end portion 501, 510, 511, 521*a*, 521*b*, 521*c*, 521*d*. The friction layer has to be guided in translation and/or rotation via a protection and guiding device of the type as described in the above cited embodiments.

In another possible embodiment, the friction layer can be connected to the end portion and its friction surface remains in contact either with the upper surface of the board, or with one of the surfaces of the protection and guiding device.

However, for a more efficient functioning of the shock-absorption device over time, the use of a flexible shock-absorption device, working in shearing is preferable. Indeed, the friction means is subject to quicker wear and tear. The shock-absorption conditions can also vary depending on the conditions. For example, if the snow is wet, water can penetrate inside and get interspersed between the friction surface of the layer and the surface that is subject to the friction (ski or casing) and thus affect the shock-absorption.

Figure 18:
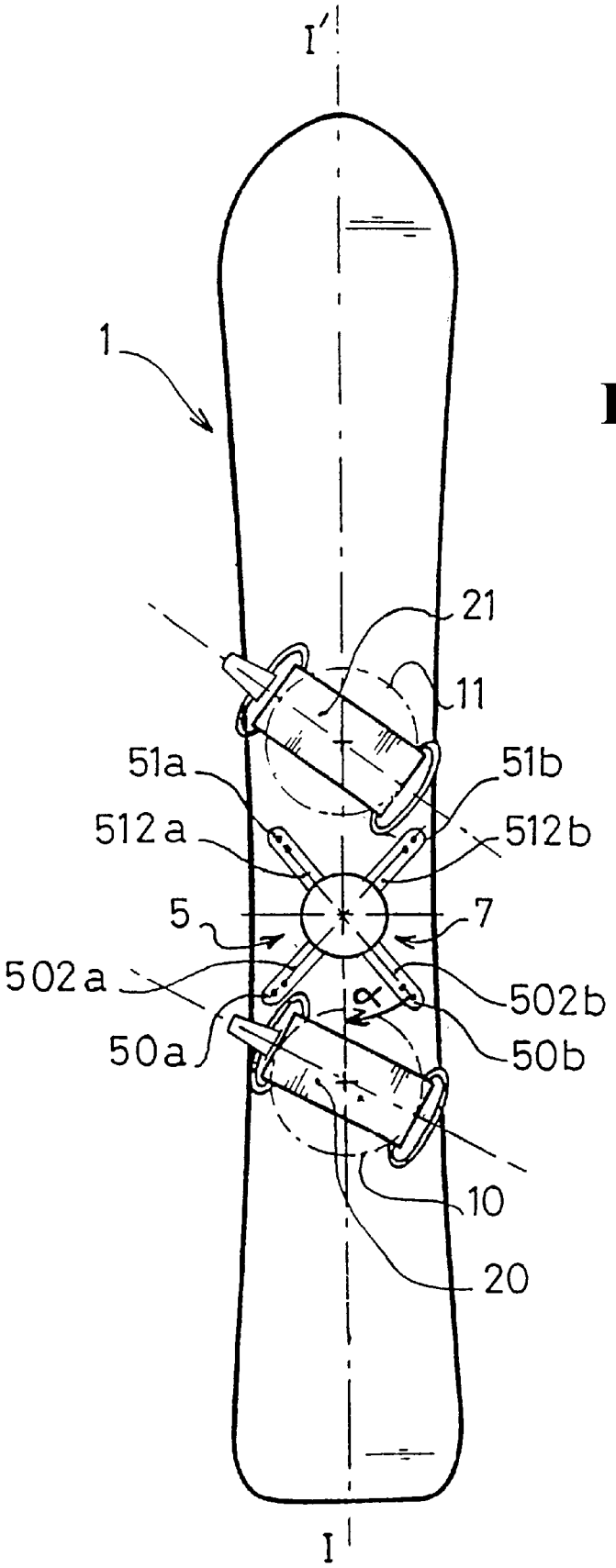
FIG. 18 is a top view of a board according to another variation of the invention.
Figure 19:
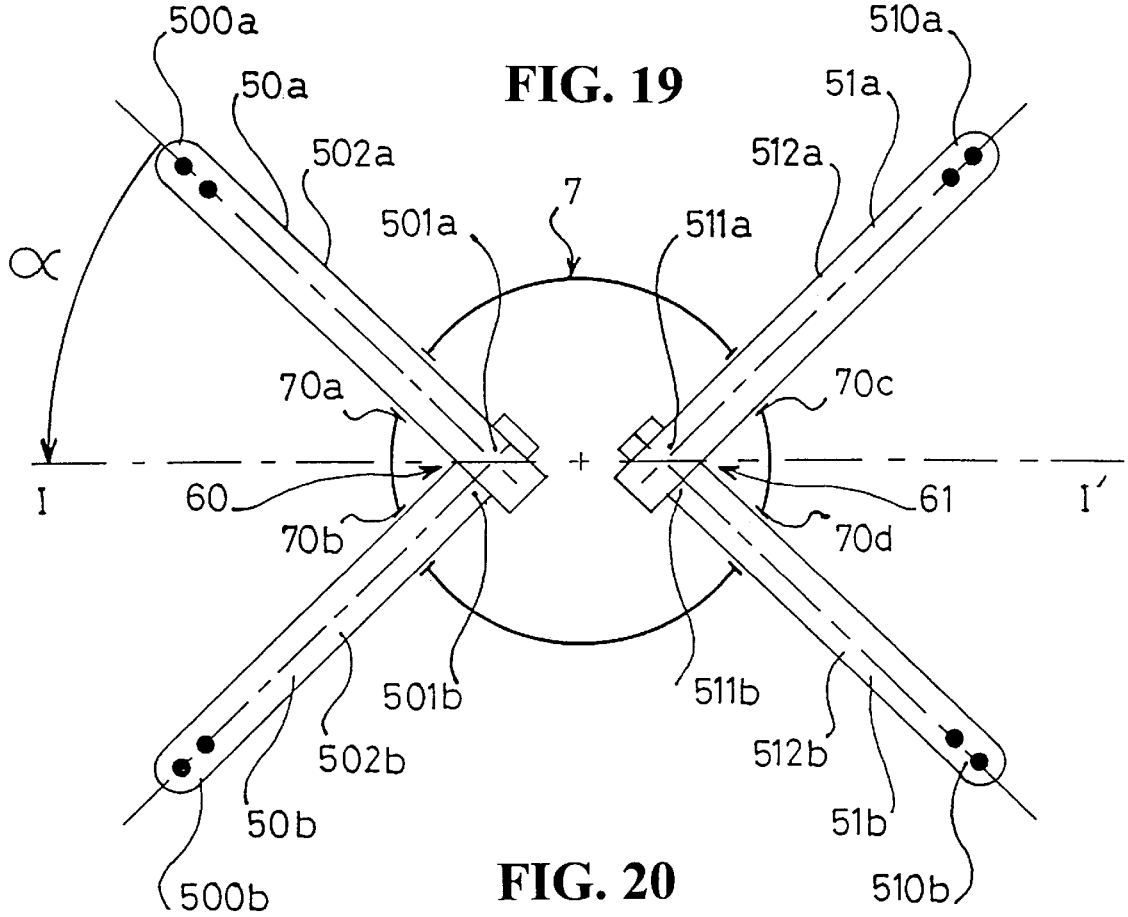
FIG. 19 shows a detail of FIG. 18.
Figure 20:
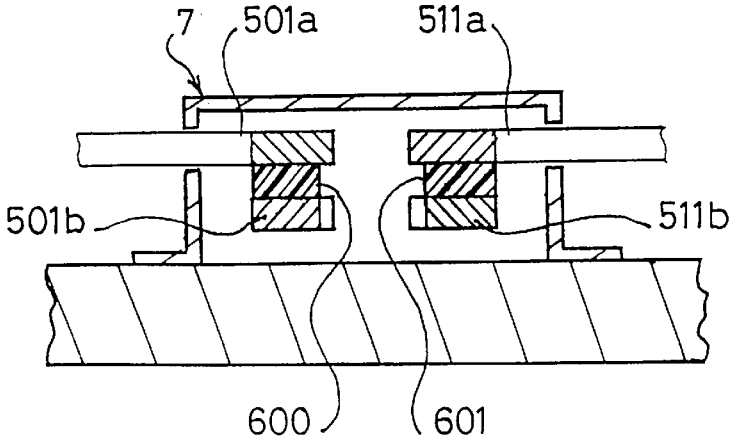
FIG. 20 is a sectional view of the view of FIG. 19.

With reference to FIGS. 18 through 20 that show another variation of the invention, the central portion 2 of the snowboard represented comprises a shock-absorption device 5 connected to the board.

The device 5 comprises four elongate elements 50*a*, 50*b*, 51*a*, 51*b* that are grouped together in pairs.

Each elongate element is oriented in an inclined manner with respect to the longitudinal direction of the axis I-I'. Preferably, the inclination $\alpha$ of each element with respect to I-I' is close to 45°.

Each of the elements has a first end portion 500*a*, 500*b*, 510*a*, 510*b* that is connected to the board via a fixed connection, such as via screws that extend through the element and become anchored into the body of the board. The screws can be replaced by any other equivalent means, such as adhesive, vibration welding, or other means.

The fixed portions are extended by the central portions 502*a*, 502*b*, 512*a*, 512*b* that have the special characteristic of not being linked to the board, and of thus being free in translation during the torsional deformation of the central portion.

Finally, the elements end in second end portions 501*a*, 501*b*, 511*a*, 511*b* that are connected in pairs via a flexible shock-absorption arrangement 600, 601.

In fact, the end portions 501*a*, 501*b* are connected to each other by a shock-absorption arrangement 60, and more specifically by means of a layer made of a flexible material 600. The same applies to the end portions 511*a*, 511*b* that are connected via shock-absorption arrangement 61 by means of a layer made of a flexible material 601.

During the displacement of the ends during the torsional stresses of the central portion, the layers 600, 601, that are preferably layers made of a visco-elastic material, are stressed by shearing and dissipate the energy transmitted by the elongate elements.

For the correct functioning of the device, it is necessary that each of the end portions 501*a*, 501*b*, 511*a*, 511*b* be guided in translation by a protection and guiding device 7, present in the form of a casing through which openings 70*a*, 70*b*, 70*c*, 70*d* are provided for the passage of the second end portions.

It should be noted that in this specific embodiment, the end portions 501*a*, 501*b*, 511*a*, 511*b* are not directly linked to the surface of the board by flexible shock-absorption means, but on the contrary, they are free to become displaced with respect to the board, especially during the bending stresses of the central portion.

Such an embodiment thus provides shock-absorption and stability during torsional deformations and retains flexibility and responsiveness during bending deformations.

The invention is not limited to the embodiments that have been expressly described therein, and includes the different variations and generalizations that fall within the scope of the following claims.

The instant application is based upon the French priority patent application No. 96.10698 filed on Aug. 29, 1996, the disclosure of which is hereby expressly incorporated by reference thereto, and the priority of which is hereby claimed under 35 USC 119.

What is claimed is:

1. A snowboard comprising:

a longitudinally extending board including:

two longitudinally spaced binding zones to secure two feet on an upper surface of said board;

a central portion located longitudinally between said two binding zones; and two end portions, said two end portions being located at respective longitudinally opposite sides of said two binding zones, at least one of said end portions terminating in a raised edge;

a shock-absorption device connected to said board at said central portion, said shock-absorption device comprising at least one elongated structure for transmitting bending and/or torsional stresses of said central portion during use of said board, said elongated structure including:

at least two opposite end portions connected to said board;

a central portion extending between said two opposite end portions but not directly contacting said board, said central portion and at least one of said end portions being free to move in translation;

a shock-absorption mechanism, at least one end portion of said at least two end portions of said elongated structure being in contact with said shock-absorption mechanism for dissipating, by shearing or friction, energy resulting from translation and/or rotation of said at least one end portion of said elongated structure during bending and/or torsional deformation of said central portion of said board.

2. A snowboard according to claim 1, wherein:

said at least one elongated structure of said shock-absorption device is constituted by two elongated transmission elements extending substantially longitudinally along said board, said two elongated transmission elements being laterally spaced apart and being located on opposite lateral sides of a median longitudinal axis of said board.

3. A snowboard according to claim 1, wherein:

said at least one elongated structure of said shock-absorption device is constituted by a cross-shaped elongated element;

said cross-shaped elongated element having two aligned and opposing pairs of arms, said two aligned and opposing arms forming four end portions extending from said central portion.

4. A snowboard according to claim 3, wherein:

each end portion extends in a direction forming an angle of approximately 45 degrees with respect to a longitudinal axis of said board.

5. A snowboard according to claim 1, wherein:

said shock-absorption mechanism comprises at least one layer of visco-elastic material directly or indirectly connecting said at least one end portion that is free to move in translation to said board.

6. A snowboard according to claim 2, wherein:

said shock-absorption mechanism comprises at least one layer of visco-elastic material directly or indirectly connecting said at least one end portion that is free to move in translation to said board.

7. A snowboard according to claim 3, wherein:

said shock-absorption mechanism comprises at least one layer of visco-elastic material directly or indirectly connecting said at least one end portion that is free to move in translation to said board.

8. A snowboard according to claim 4, wherein:

said shock-absorption mechanism comprises at least one layer of visco-elastic material directly or indirectly connecting said at least one end portion that is free to move in translation to said board.

9. A snowboard according to claim 5, wherein:

a respective protection and guiding device, fixedly connected to said board, covers an end of each of said at least one end portion.

10. A snowboard according to claim 9, wherein:

each of said respective protection and guiding device comprises a casing through which an opening is arranged for passage of a respective end of said at least one end portion, said casing having a housing within which said end is located, a quantity of visco-elastic material being contained in said housing and surrounding said end of said at least one end portion, said quantity of visco-elastic material forming an upper layer adhered above said end of said at least one end portion in a top of said housing and a lower layer adhered above the board and beneath said end of said at least one end portion.

11. A snowboard according to claim 9, wherein:

each of said respective protection and guiding device comprises a stirrup comprising a shim, a guide element being affixed to said shim, and a guide housing through which said end of each of said at least one end portion extends during said movement in translation, a layer of visco-elastic material being positioned in contacting relationship between said shim and said end.

12. A snowboard according to claim 1, wherein:

said shock-absorption device is constituted by four elongated elements, each extending at an angle with respect to a longitudinal median axis of said board;

said four elongated elements comprise:

first end portions connected to said board by means of respective fixed connections; and second end portions extending in a direction toward said longitudinal median axis of said board, two pairs of said second end portions being connected by means of a layer of flexible material, said second end portions being guided in translation via a protection and guiding device in the form of a casing having openings for passage of said second end portions.

13. A snowboard according to claim 1, wherein:

said elongated structure for transmitting bending and/or torsional stresses of said central zone during use of said board is in the form of reinforced blades, profiles, rings, rods, or tubes.

14. A snowboard according to claim 1, wherein:

said elongated structure for transmitting bending and/or torsional stresses of said central zone during use of said board comprises a high modulus material, said material comprising a member selected from the group consisting of fiber glass, acrylic fibers, polyester-based fibers and mixtures of such fibers.

15. A snowboard comprising:

a longitudinally extending board including:

two longitudinally spaced binding zones to secure two feet on an upper surface of said board;

a central portion located longitudinally between said two binding zones; and two end portions, said two end portions being located at respective longitudinally opposite sides of said two binding zones, at least one of said end portions terminating in a raised edge;

a shock-absorption device connected to said board at said central portion, said shock absorption device extending only within said central portion of said board, said shock-absorption device comprising at least one elongated structure for transmitting bending and/or torsional stresses of said central portion during use of said board, said elongated structure including:

at least two opposite end portions, at least one of said end portions being affixed to said board against movement with respect to said board;

a central portion extending between said two opposite end portions, said central portion and at least one of said end portions being movable end portion, said movable end portion being free to move in translation;

a shock-absorption material, said movable end portion of said at least two end portions of said elongated structure being in contact with said shock-absorption material for dissipating, by shearing or friction, energy resulting from translation and/or rotation of said movable end portion of said elongated structure during bending and/or torsional deformation of said central portion of said board.

16. A snowboard according to claim 15, wherein:

said at least one elongated structure of said shock-absorption device is constituted by two elongated transmission elements extending substantially longitudinally along said board, said two elongated transmission elements being laterally spaced apart and being located on opposite lateral sides of a median longitudinal axis of said board.

17. A snowboard according to claim 15, wherein:

said at least one elongated structure of said shock-absorption device is constituted by a cross-shaped elongated element;

said cross-shaped elongated element having two aligned and opposing pairs of arms, said two aligned and opposing arms forming four end portions extending from said central portion.

18. A snowboard according to claim 17, wherein:

each end portion extends in a direction forming an angle of approximately 45 degrees with respect to a longitudinal axis of said board.

19. A snowboard according to claim 15, wherein:

said shock-absorption material comprises at least one layer of visco-elastic material directly or indirectly connecting said movable end portion of said board.

* * * * *